US010522085B2

(12) United States Patent
Jeong et al.

(10) Patent No.: US 10,522,085 B2
(45) Date of Patent: Dec. 31, 2019

(54) ORGANIC LIGHT-EMITTING DISPLAY DEVICE HAVING SOURCE DRIVE INTEGRATED CIRCUITS AND DRIVING METHOD THEREOF

(71) Applicant: LG Display Co., Ltd., Seoul (KR)

(72) Inventors: Uitaek Jeong, Gyeonggi-do (KR); MooKyoung Hong, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/657,456

(22) Filed: Jul. 24, 2017

(65) Prior Publication Data

US 2018/0033374 A1 Feb. 1, 2018

(30) Foreign Application Priority Data

Jul. 29, 2016 (KR) ..... 10-2016-0096784

(51) Int. Cl.

| | |
|---|---|
| ***G09G 3/3258*** | (2016.01) |
| ***G09G 3/36*** | (2006.01) |
| ***G09G 3/20*** | (2006.01) |
| *G09G 3/28* | (2013.01) |
| *G09G 3/34* | (2006.01) |

(52) U.S. Cl.

CPC ..... *G09G 3/3258* (2013.01); *G09G 3/2088* (2013.01); *G09G 3/3618* (2013.01); *G09G 3/28* (2013.01); *G09G 3/3406* (2013.01)

(58) Field of Classification Search

CPC .. G09G 3/2088; G09G 3/3618; G09G 3/3258; G09G 3/28; G09G 3/3406

See application file for complete search history.

(56) References Cited

U.S. PATENT DOCUMENTS

2002/0089357 A1 7/2002 Pae et al.
2012/0050350 A1 3/2012 Matsui
(Continued)

FOREIGN PATENT DOCUMENTS

CN 101221727 A 7/2008
CN 102388414 A 3/2012
(Continued)

OTHER PUBLICATIONS

First Notification of Office Action dated Aug. 9, 2019, issued in corresponding Chinese Patent Application No. 201710617642.X.

*Primary Examiner* — Kwang-Su Yang
(74) *Attorney, Agent, or Firm* — Morgan, Lewis & Bockius LLP

(57) ABSTRACT

An organic light-emitting display device includes: a display panel including: a plurality of pixels configured to display an image, each pixel among the plurality of pixels including a driving transistor and a sensing transistor, a plurality of data lines respectively connected to each driving transistor, and a plurality of sensing signal lines respectively connected to each sensing transistor, a plurality of source drive integrated circuits (ICs) configured to: supply data voltages to the plurality of data lines, and supply sensing voltages to the plurality of sensing signal lines, and a timing controller configured to supply digital video data and a data timing control signal to the source driver ICs, wherein each of the plurality of source driver ICs includes a sensing voltage supply unit configured to generate the sensing voltages.

10 Claims, 6 Drawing Sheets

(56) References Cited

U.S. PATENT DOCUMENTS

| | | | | |
|---|---|---|---|---|
| 2014/0152642 | A1* | 6/2014 | Kim | G09G 3/3233 345/212 |
| 2014/0176525 | A1* | 6/2014 | Woo | G09G 3/3233 345/212 |
| 2014/0176622 | A1* | 6/2014 | Jung | G09G 3/3208 345/690 |
| 2015/0015491 | A1 | 6/2015 | Kim | |
| 2015/0154913 | A1 | 6/2015 | Kim | |
| 2016/0005354 | A1 | 1/2016 | Takasugi et al. | |
| 2016/0148564 | A1* | 5/2016 | Kim | G09G 3/3233 345/211 |
| 2016/0163265 | A1 | 6/2016 | Yang et al. | |
| 2017/0032738 | A1* | 2/2017 | Lee | G09G 3/3233 |
| 2017/0039953 | A1* | 2/2017 | Lee | G09G 3/3233 |
| 2017/0193918 | A1* | 7/2017 | Bae | G09G 3/3283 |

FOREIGN PATENT DOCUMENTS

| | | | | | |
|---|---|---|---|---|---|
| CN | 104700773 | A | | 6/2015 | |
| CN | 105261330 | A | | 1/2016 | |
| CN | 105702208 | A | | 6/2016 | |
| KR | 1020150078360 | A | * | 7/2015 | G09G 3/3258 |

* cited by examiner

ORGANIC LIGHT-EMITTING DISPLAY DEVICE HAVING SOURCE DRIVE INTEGRATED CIRCUITS AND DRIVING METHOD THEREOF

CROSS-REFERENCE TO RELATED APPLICATIONS

This application claims the priority of Korean Application No. 10-2016-0096784, filed on Jul. 29, 2016, the entirety of which is hereby incorporated by reference.

BACKGROUND

1. Technical Field

The present disclosure relates to an organic light-emitting display device and a driving method thereof.

2. Discussion of the Related Art

With the advancement of an information-oriented society, various desires for display devices for displaying an image are increasing. Therefore, various display devices, such as liquid crystal display (LCD) devices, plasma display panel (PDP) devices, organic light-emitting display devices, etc. have been used recently.

Among these display devices, the organic light-emitting display devices are driven with a low voltage and are thin, and have a good viewing angle and a fast response time. The organic light-emitting display devices each include a display panel that includes a plurality of data lines, a plurality of scan lines, and a plurality of pixels respectively provided in a plurality of areas defined by intersections of the data lines and the scan lines, a scan driver that supplies scan signals to the scan lines, and a data driver that supplies data voltages to the data lines. The plurality of pixels each include an organic light-emitting diode (OLED), a driving transistor that controls the amount of current supplied to the OLED according to a voltage at a gate electrode thereof, and a scan transistor that supplies a data voltage of a data line to the gate electrode of the driving transistor in response to a scan signal of a scan line.

Due to differences in processes occurring in manufacturing an organic light-emitting display device or a threshold voltage shift of a driving transistor caused by long-time driving, the threshold voltages and electron mobility of driving transistors of pixels differ. Therefore, when the same data voltage is supplied to the pixels, the currents of the driving transistors supplied to OLEDs should be the same. However, despite the same data voltage being supplied to the pixels, the currents of the driving transistors supplied to OLEDs differ due to a threshold voltage difference and an electron mobility difference between the driving transistors of the pixels. As a result, even when the same data voltage is supplied to the pixels, light emitted from the OLEDs of different pixels have different luminances. To solve such problems, a compensation method of compensating for threshold voltages and electron mobility of driving transistors has been proposed.

The compensation method may be categorized into an "internal" compensation method and an "external" compensation method. The internal compensation method senses and compensates for a threshold voltage of a driving transistor in each pixel. The external compensation method supplies a predetermined data voltage to each pixel and senses a current of the driving transistor through a sensing line according to the predetermined data voltage. Subsequently, the external compensation method converts the sensed current into digital video data and compensates for digital video data to be supplied to each pixel, based on the digital video data obtained through the conversion.

The organic light-emitting display device uses a supply voltage from a power source built into a control printed circuit board (C-PCB) outside a source drive integrated circuit (IC) to generate a sensing voltage and a data voltage necessary for performing the external compensation method and a reference voltage for controlling a luminance of an entire display panel. The source driver IC performs sensing based on the external compensation method by using the voltages supplied thereto.

In the organic light-emitting display devices of the related art, if the sensing voltage is supplied from C-PCB, areas disposed on sides, e.g., a left end and a right end, of the display panel are farther away from the C-PCB than an area disposed on a center of the display panel. Therefore, because a resistance caused by a line is high, a low sensing voltage is supplied. When the sensing voltage is lowered, even when the same data voltage and reference voltage are supplied, compensation is performed differently. Therefore, as time elapses, a difference occurs between the data voltage and the reference voltage. As such, a luminance deviation between areas of the display panel occurs.

Furthermore, in addition to the sensing voltage, the data voltage and the reference voltage are differently supplied, depending on an area characteristic of the display panel. Because the areas disposed on the sides, e.g., the left end and the right end, of the display panel are farther away from the C-PCB than the area disposed on the center of the display panel, when the data voltage and the reference voltage are supplied from the C-PCB, a resistance caused by a line is high. Also, the physical characteristics of pixels provided in the areas disposed on the sides, e.g., the left end and the right end, of the display panel can differ from those of the area disposed on the center. For this reason, luminance in the areas disposed on the sides, e.g., the left end and the right end, of the display panel is more reduced than luminance in the area disposed on the center, causing a luminance deviation between the areas of the display panel.

Particularly, in large organic light-emitting display devices, a physical characteristic difference between the pixels provided in the display panel and a length difference of lines connected between the C-PCB and the display panel occur, causing voltage drop where levels of the sensing voltage, the data voltage, and the reference voltage supplied from the C-PCB are reduced progressively closer to both ends of the display panel. External compensation is sensitive to power supplied to the source driver IC. When the voltage drop occurs, an error occurs in sensing data.

In detail, when the reference voltage is not uniform in the areas of the display panel, a luminance difference occurs. Also, when levels of sensing voltages differ depending on source driver ICs respectively corresponding to the areas of the display panel, noise occurs in the sensing data, causing a defect, such as block dim.

SUMMARY

Accordingly, the present disclosure is directed to an organic light-emitting display device and a driving method thereof that substantially obviate one or more of the issues due to limitations and disadvantages of the related art.

An aspect of the present disclosure is to provide an organic light-emitting display device and a driving method thereof, which prevent occurrence of voltage drop where levels of a sensing voltage, a data voltage, and a reference voltage are reduced progressively closer to both ends of a display panel.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts as embodied and broadly described, there is provided an organic light-emitting display device, including: a display panel including: a plurality of pixels configured to display an image, each pixel among the plurality of pixels including a driving transistor and a sensing transistor, a plurality of data lines respectively connected to each driving transistor, and a plurality of sensing signal lines respectively connected to each sensing transistor, a plurality of source drive integrated circuits (ICs) configured to: supply data voltages to the plurality of data lines, and supply sensing voltages to the plurality of sensing signal lines, and a timing controller configured to supply digital video data and a data timing control signal to the source driver ICs, wherein each of the plurality of source driver ICs includes a sensing voltage supply unit configured to generate the sensing voltages.

In another aspect, there is provided a method of driving method of an organic light-emitting display device, the driving method including: supplying, by a timing controller, digital video data and a data timing control signal to a plurality of source drive integrated circuits (ICs), supplying, by the source driver ICs, data voltages to a plurality of data lines connected to driving transistors of a plurality of pixels provided in a display panel, generating, by each of the source driver ICs, sensing voltages, and supplying, by the source driver ICs, sensing voltages to a plurality of sensing signal lines connected to sensing transistors of the plurality of pixels provided in a display panel, wherein each of the plurality of source driver ICs includes a sensing voltage supply unit generating the sensing voltages.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain various principles of the disclosure.

Figure 1:
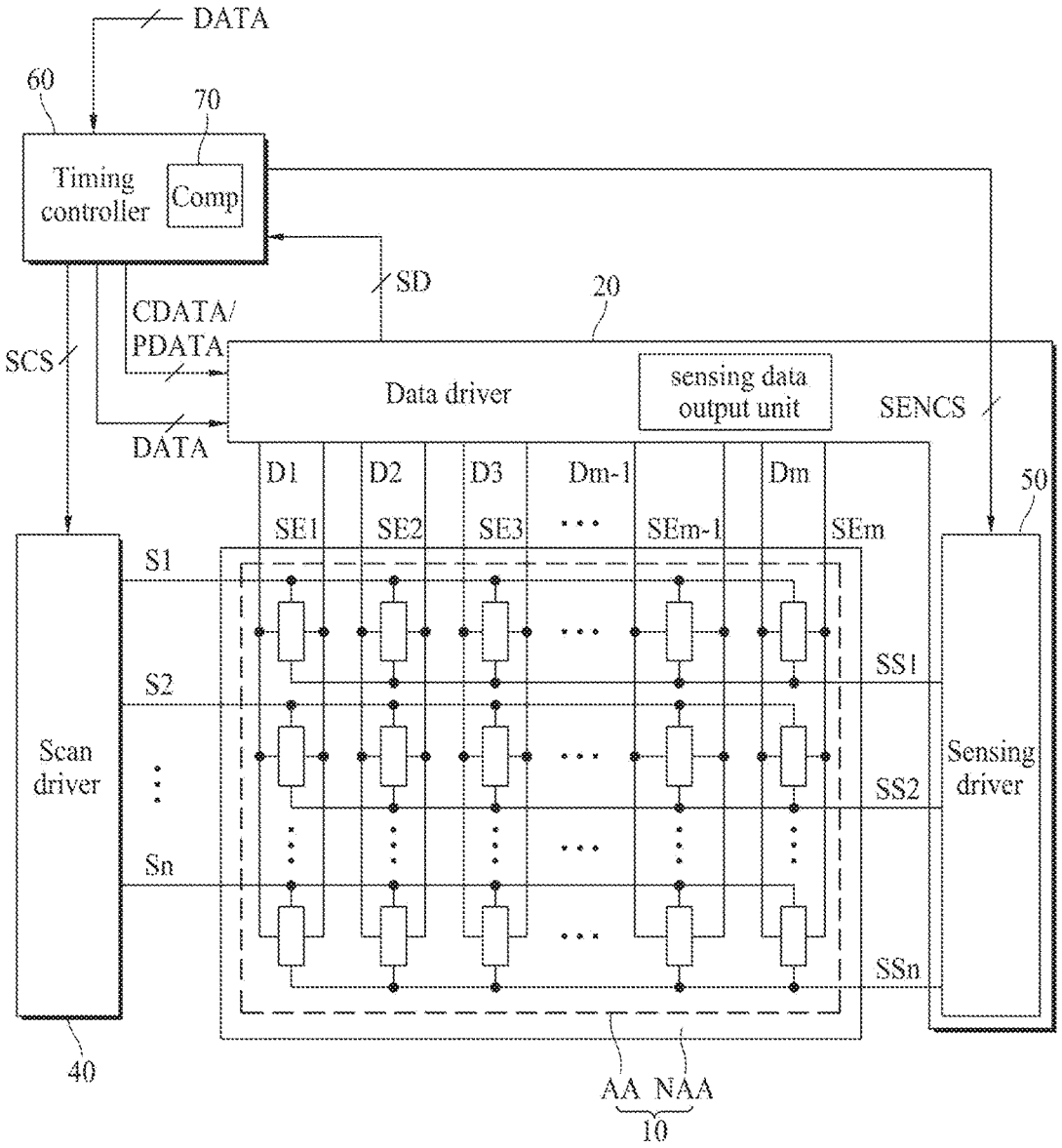
FIG. 1 is a block diagram illustrating an organic light-emitting display device according to an embodiment of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to some embodiments of the present disclosure, examples of which are illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

In the description of embodiments, when a structure is described as being positioned "on or above" or "under or below" another structure, this description should be construed as including a case in which the structures contact each other as well as a case in which a third structure is disposed therebetween.

Figure 2:
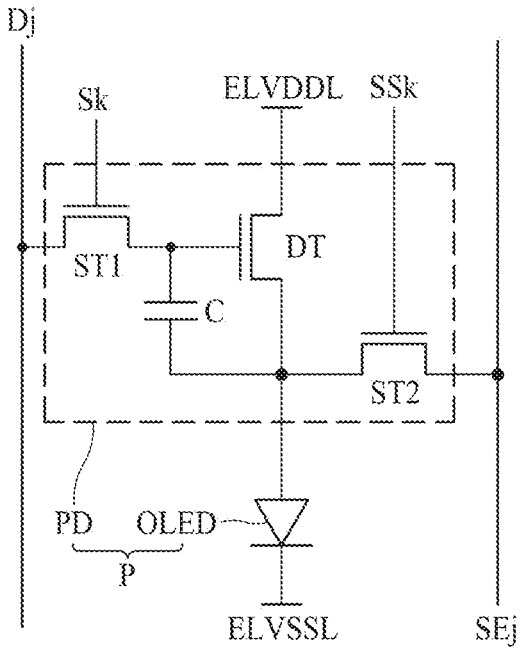
FIG. 2 is a circuit diagram illustrating, in detail, a pixel of FIG. 1.

FIG. 1 is a block diagram illustrating an organic light-emitting display device according to an embodiment of the present disclosure. FIG. 2 is a circuit diagram illustrating, in detail, a pixel of FIG. 1.

With reference to FIG. 1, the organic light-emitting display device according to an embodiment of the present disclosure may include a display panel 10, a data driver 20, a scan driver 40, a sensing driver 50, a timing controller 60, and a digital video data compensator 70. The display panel 10 may include a display area AA and a non-display area NAA near the display area AA. The display area AA may be an area where a plurality of pixels is provided to display an image. A plurality of data lines D1 to Dm (where m is a positive integer equal to or greater than two), a plurality of sensing lines SE1 to SEm, a plurality of scan lines S1 to Sn (where n is a positive integer equal to or greater than two), and a plurality of sensing signal lines SS1 to SSn may be provided in the display panel 10. The data lines D1 to Dm and the sensing lines SE1 to SEm may intersect the scan lines S1 to Sn and the sensing signal lines SS1 to SSn. The data lines D1 to Dm and the sensing lines SE1 to SEm may be parallel to each other, and the scan lines S1 to Sn and the sensing signal lines SS1 to SSn may be parallel to each other.

Each of the pixels may be connected to one corresponding data line of the data lines D1 to Dm, one corresponding sensing line of the sensing lines SE1 to SEm, one corresponding scan line of the scan lines S1 to Sn, and one corresponding sensing signal line of the sensing signal lines SS1 to SSn. The pixels of the display panel 10, as in the FIG. 2 example, may each include an organic light-emitting diode OLED and a pixel driver PD that supplies a current to the organic light-emitting diode OLED. A detailed description of each of the pixels will be described below with reference to FIG. 2.

The data driver 20 may receive digital video data DATA, compensation data CDATA, and sensing setting data PDATA from the timing controller 60. The data driver 20 may respectively supply data voltages to the data lines D1 to Dm by using the digital video data DATA. The data driver 20 may sense a current flowing in each of the sensing lines SE1 to SEm by using the sensing setting data PDATA. The data driver 20 may supply data voltages generated through compensation to the data lines D1 to Dm by using the compensation data CDATA. The data driver 20 may include a sensing data output unit. The data driver 20 may transfer sensing data SD, output from the sensing data output unit, to the timing controller 60.

Moreover, the data driver 20 may include the sensing driver 50. The data driver 20 may be connected to the sensing signal lines SS1 to SSn, and may supply sensing signals. The data driver 20 may include a plurality of source driver ICs 21. A detailed description of each of the source driver ICs 21 will be described below with reference to FIGS. 3 to 5.

Figure 3:
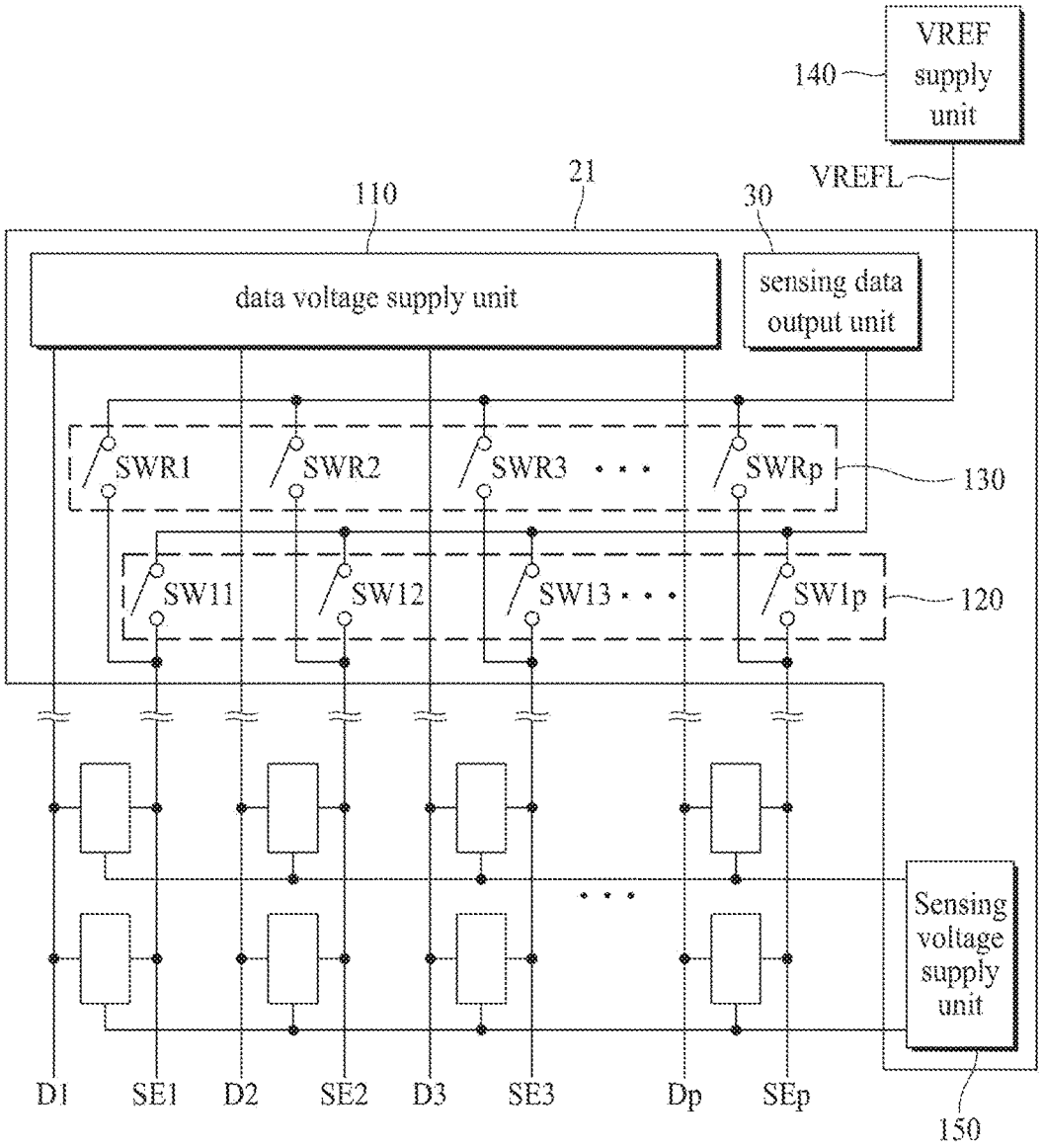
FIG. 3 is a block diagram illustrating, in detail, a source driver IC according to an embodiment of the present disclosure.
Figure 4:
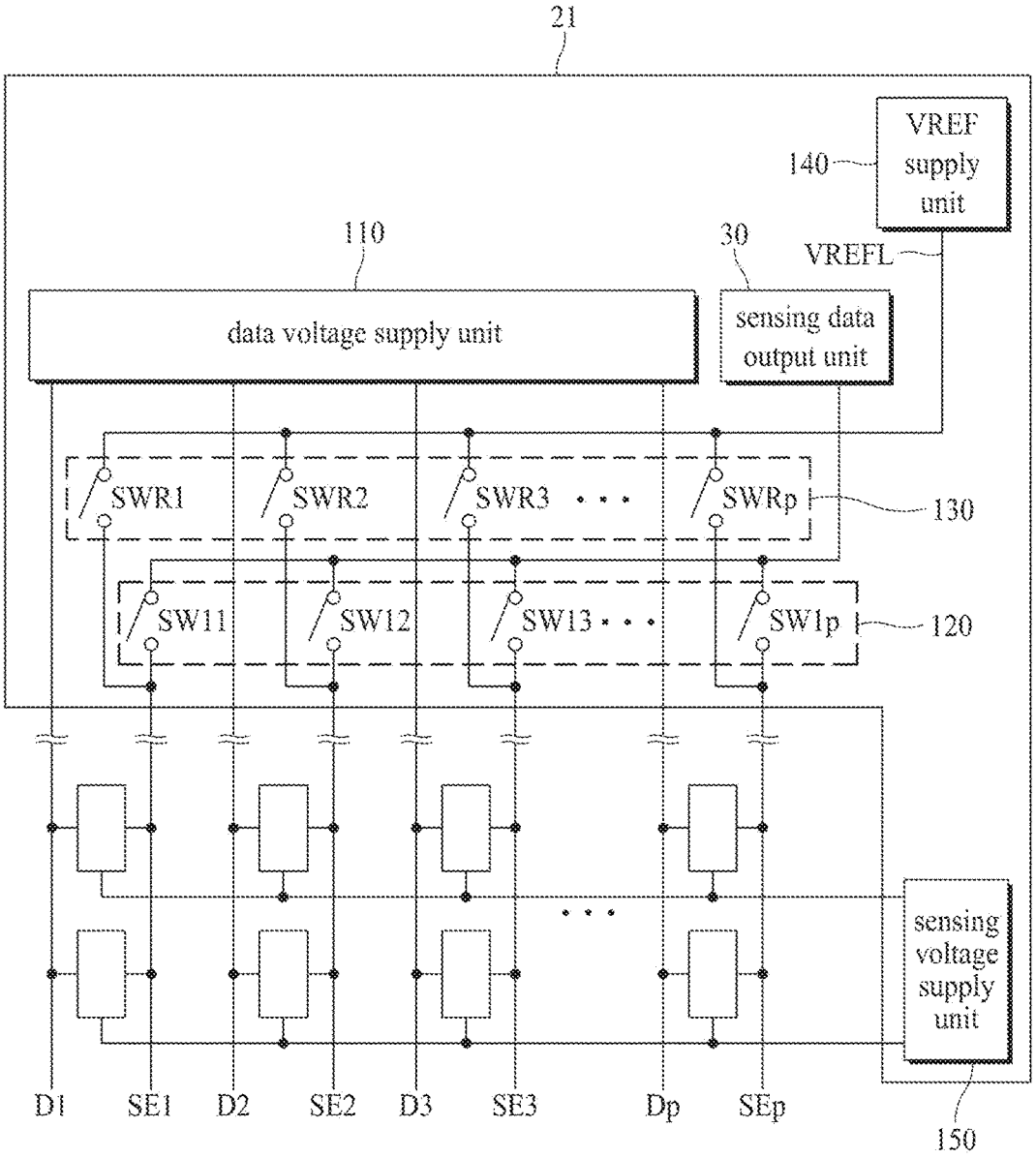
FIG. 4 is a block diagram illustrating, in detail, a source driver IC according to another embodiment of the present disclosure.
Figure 5:
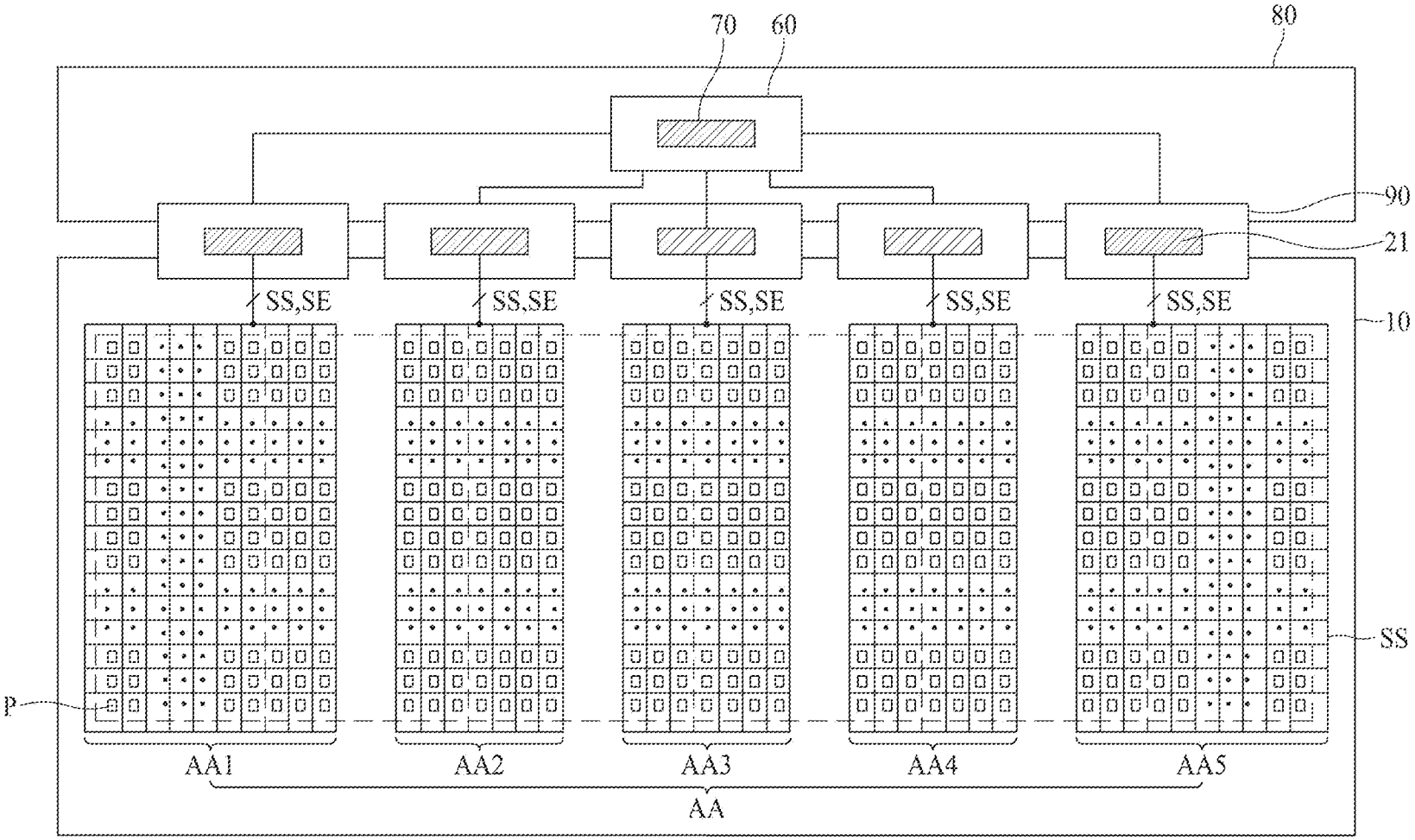
FIG. 5 is a circuit diagram of an organic light-emitting display device according to an embodiment of the present disclosure.

FIG. 3 is a block diagram illustrating in detail, a source driver IC according to an embodiment of the present disclosure. FIG. 4 is a block diagram illustrating, in detail, a source driver IC according to another embodiment of the present disclosure. FIG. 5 is a circuit diagram of an organic light-emitting display device according to an embodiment of the present disclosure.

The scan driver 40 may be connected to the scan lines S1 to Sn, and may supply scan signals. The scan driver 40 may supply the scan signals to the scan lines S1 to Sn according to a scan timing control signal SCS input from the timing controller 60. The scan driver 40 may sequentially supply the scan signals to the scan lines S1 to Sn. In such case, the scan driver 40 may include a shift register. A scan timing control signal SCS of a display mode may differ from a scan timing control signal SCS of a sensing mode. Therefore, a scan signal waveform of the scan driver 40 in the display mode may differ from a scan signal waveform of the scan driver 40 in the sensing mode.

The scan driver 40 may include a plurality of transistors, and may be directly provided as a gate driver in panel (GIP) type in the non-display area NAA of the display panel 10. Alternatively, the scan driver 40 may be implemented as a driving chip type, and may be mounted on a flexible film connected to the display panel 10.

The sensing driver 50 may be connected to the sensing signal lines SS1 to SSn, and may supply sensing signals. The sensing driver 50 may supply the sensing signals to the sensing signal lines SS1 to SSn according to a sensing timing control signal SENCS input from the timing controller 60. The sensing driver 50 may sequentially supply the sensing signals to the sensing signal lines SS1 to SSn. In such case, the sensing driver 50 may include a shift register. A sensing timing control signal SENCS of the display mode may differ from a sensing timing control signal SENCS of the sensing mode. Therefore, a sensing signal waveform of the sensing driver 50 in the display mode may differ from a sensing signal waveform of the sensing driver 50 in the sensing mode.

The timing controller 60 may receive the digital video data DATA and a timing signal from an external system board. The timing signal may include a vertical sync signal, a horizontal sync signal, a data enable signal, and a dot clock.

The timing controller 60 may generate timing control signals for controlling the operation timings of the data driver 20, the scan driver 40, and the sensing driver 50. The timing control signals may include a data timing control signal DCS of the operation timing of the data driver 20, a scan timing control signal SCS for controlling the operation timing of the scan driver 40, and the sensing timing control signal SENCS for controlling the operation timing of the sensing driver 50.

Moreover, the timing controller 60 may generate a mode signal according to one mode of the display mode and the sensing mode for driving the data driver 20, the scan driver 40, the sensing driver 50, and the digital video data compensator 70. The timing controller 60 may operate the data driver 20, the scan driver 40, and the sensing driver 50 in one mode of the display mode and the sensing mode according to the mode signal. The display mode may be a mode in which the pixels of the display panel 10 display an image, and the sensing mode may be a mode in which each of the pixels of the display panel 10 generates a current of a driving transistor DT thereof. When a waveform of the scan signal and a waveform of the sensing signal supplied to each of the pixels are changed in each of the display mode and the sensing mode, the data timing control signal DCS, the scan timing control signal SCS, and the sensing timing control signal SENCS may also be changed in each of the display mode and the sensing mode. Therefore, the timing controller 60 may generate the data timing control signal DCS, the scan timing control signal SCS, and the sensing timing control signal SENCS, according to one mode of the display mode and the sensing mode.

The timing controller 60 may include the digital video data compensator 70. The timing controller 60 may supply the compensation data CDATA generated by the digital video data compensator 70 or the sensing setting data PDATA and the data timing control signal DCS to the data driver 20. The timing controller 60 may output the scan timing control signal SCS to the scan driver 40. The timing controller 60 may output the sensing timing control signal SENCS to the sensing driver 50.

The digital video data compensator 70 may be included in the timing controller 60. The digital video data compensator 70 may store sensing data SD, input from the data driver 20 to the timing controller 60, in a memory. Also, the digital video data compensator 70 may receive the mode signal from the timing controller 60. In the display mode, the digital video data compensator 70 may convert the digital video data DATA into the compensation data CDATA, based on the sensing data SD, thereby compensating for a threshold voltage and an electron mobility of the driving transistor DT.

The sensing data SD may be data that is generated by sensing a current flowing through the driving transistor DT when a certain data voltage is supplied to a gate electrode of the driving transistor DT of each pixel. The compensation data CDATA may be data that is generated by compensating for the digital video data DATA to decrease distortion caused by a characteristic of the driving transistor DT by compensating for the threshold voltage and electron mobility of the driving transistor DT of each of the pixels.

The digital video data compensator 70 may calculate data for compensating for the threshold voltage and electron mobility of the driving transistor DT by using a particular algorithm, based on the sensing data SD. The digital video data compensator 70 may apply the calculated data to the digital video data DATA to calculate the compensation data CDATA. The digital video data compensator 70 may transfer the compensation data CDATA to the timing controller 60 in the display mode. Distortion caused by the characteristic of the driving transistor DT may be reduced more when the timing controller 60 supplies the compensation data CDATA to the source driver IC 21, than when the timing controller 60 directly supplies the digital video data DATA to the source driver IC 21.

The digital video data compensator 70 may transfer the sensing setting data PDATA, stored in the memory, to the timing controller 60 in the sensing mode. The sensing setting data PDATA may be data for sensing a current of the driving transistor in each pixel.

With further reference to FIG. 2, in FIG. 2, for convenience of description, only a pixel P connected to a $j^{th}$ (where j is a positive integer satisfying $1 \leq j \leq m$) data line Dj, a $j^{th}$ sensing line SEj, a $k^{th}$ (where k is a positive integer satisfying $1 \leq k \leq n$) scan line Sk, and a $k^{th}$ sensing signal line SSk is illustrated. In the FIG. 2 example, the pixel P of the display panel 10 may include an organic light-emitting diode OLED and a pixel driver PD that supplies a current to the $j^{th}$ sensing line SEj.

The pixel driver PD may include a driving transistor DT, a first transistor ST1 controlled by a scan signal of the scan line Sk, a second transistor ST2 controlled by a sensing signal of the sensing signal line SSk, and a capacitor C. In the display mode, when the scan signal is supplied through the scan line Sk connected to the pixel P, the pixel driver PD may be supplied with an emission data voltage of the data line Dj connected to the pixel P, and may supply a current of the driving transistor DT to the organic light-emitting diode OLED according to the emission data voltage. In the sensing mode, when the scan signal is supplied through the scan line Sk connected to the pixel P, the pixel driver PD may be supplied with a sensing data voltage of the data line Dj connected to the pixel P, and may supply the current of the driving transistor DT to the sensing line SEj connected to the pixel P.

The organic light-emitting diode OLED may emit light with the current supplied through the driving transistor DT. An anode electrode of the organic light-emitting diode OLED may be connected to a source electrode of the driving transistor DT, and a cathode electrode may be connected to a low-level voltage line ELVSSL through which a low-level source voltage higher than a high-level voltage may be supplied.

The organic light-emitting diode OLED may include the anode electrode, a hole transporting layer, an organic light-emitting layer, an electron transporting layer, and the cathode electrode. When a voltage is applied to the anode electrode and the cathode electrode, a hole and an electron may respectively move to the organic light-emitting layer through the hole transporting layer and the electron transporting layer, and may be combined with each other in the organic light-emitting layer to emit light.

The driving transistor DT may be provided between a high-level voltage line ELVDDL and the organic light-emitting diode OLED. The driving transistor DT may control a current flowing from the high-level voltage line ELVDDL to the organic light-emitting diode OLED, based on a voltage difference between a gate electrode and a source electrode of the driving transistor DT. The gate electrode of the driving transistor DT may be connected to a first electrode of the first transistor ST1, the source electrode may be connected to the anode electrode of the organic light-emitting diode OLED, and a drain electrode may be connected to the high-level voltage line ELVDDL through which a high-level voltage is supplied.

The first transistor ST1 may be turned on by a $k^{th}$ scan signal of the $k^{th}$ scan line Sk, and may supply a voltage of the $j^{th}$ data line Dj to the gate electrode of the driving transistor DT. A gate electrode of the first transistor ST1 may be connected to the $k^{th}$ scan line Sk, a first electrode may be connected to the gate electrode of the driving transistor DT, and a second electrode may be connected to the $j^{th}$ data line Dj. The first transistor ST1 may be referred to as a "scan transistor."

The second transistor ST2 may be turned on by a $k^{th}$ sensing signal of the $k^{th}$ sensing signal line SSk, and may connect the $j^{th}$ sensing line SEj to the source electrode of the driving transistor DT. A gate electrode of the second transistor ST2 may be connected to the $k^{th}$ sensing signal line SSk, a first electrode may be connected to the $j^{th}$ sensing line SEj, and a second electrode may be connected to the source electrode of the driving transistor DT. The second transistor ST2 may be referred to as a "sensing transistor."

The capacitor C may be provided between the gate electrode and the source electrode of the driving transistor DT. The capacitor C may store a difference voltage between a gate voltage and a source voltage of the driving transistor DT.

In FIG. 2, an example in which the driving transistor DT and the first and second transistors ST1 and ST2 are each formed of an N-type metal oxide semiconductor field effect transistor (MOSFET) has been described, but embodiments of the present disclosure are not limited thereto. For example, the driving transistor DT and the first and second transistors ST1 and ST2 may each be formed of a P-type MOSFET. Also, the first electrode may be a source electrode, and the second electrode may be a drain electrode, but embodiments of the present disclosure are not limited thereto. In some embodiments, the first electrode may be a drain electrode, and the second electrode may be a source electrode.

In the display mode, when the scan signal is supplied to the $k^{th}$ scan line Sk, an emission data voltage of the $j^{th}$ data line Dj may be supplied to the gate electrode of the driving transistor DT. Also, when the sensing signal is supplied to the $k^{th}$ sensing signal line SSk, a reference voltage of the $j^{th}$ sensing line SEj may be supplied to the source electrode of the driving transistor DT. Therefore, in the display mode, a current of the driving transistor DT that flows according to a voltage difference between a voltage at the gate electrode and a voltage at the source electrode of the driving transistor DT may be supplied to the organic light-emitting diode OLED, and the organic light-emitting diode OLED may emit light with the current of the driving transistor DT. In such a case, the emission data voltage may be a voltage generated by compensating for a threshold voltage and an electron mobility of the driving transistor DT. Thus, the current of the driving transistor DT may not depend on the threshold voltage and electron mobility of the driving transistor DT.

In the sensing mode, when the scan signal is supplied to the $k^{th}$ scan line Sk, a sensing data voltage of the $j^{th}$ data line Dj may be supplied to the gate electrode of the driving transistor DT. Also, when the sensing signal is supplied to the $k^{th}$ sensing signal line SSk, the reference voltage of the $j^{th}$ sensing line SEj may be supplied to the source electrode of the driving transistor DT. Furthermore, in the sensing mode, the second transistor ST2 may be turned on by the sensing signal of the $k^{th}$ sensing signal line SSk. Thus, the current of the driving transistor DT that flows according to the voltage difference between the voltage at the gate electrode and the voltage at the source electrode of the driving transistor DT may flow to the $j^{th}$ sensing line SEj. As a result, the sensing data output unit may sense a current flowing in the $j^{th}$ sensing line SEj to output sensing data SD, and the digital video data compensator 70 may perform external compensation on the threshold voltage and electron mobility of the driving transistor DT by using the sensing data SD.

With reference to FIG. 3, the source driver IC may be provided in plurality, and the plurality of source driver ICs may each include a data voltage supply unit 110, a switching unit 120, an initialization voltage supply unit 130, and a sensing voltage supply unit 150. In FIG. 3, for convenience of description, an example in which the data voltage supply unit 110 is connected to p (where p is a positive integer satisfying $1 \leq p \leq m$) number of data lines D1 to Dp and the switching unit 120, and the initialization voltage supply unit 130 are connected to p number of sensing lines SE1 to SEp, will be described below.

The data voltage supply unit 110 may be connected to the data lines D1 to Dp and may supply data voltages. The data voltage supply unit 110 may receive compensation data CDATA or sensing setting data PDATA, and a data timing control signal DCS, from the timing controller 60. In the display mode, the data voltage supply unit 110 may convert the compensation data CDATA into emission data voltages, and may respectively supply the emission data voltages to the data lines D1 to Dp according to the data timing control signal DCS. Each of the emission data voltages may be a voltage for allowing an organic light-emitting diode OLED of a pixel to emit light having a particular luminance. In one example, if the compensation data CDATA supplied to the data driver 20 consists of 8 bits, each of the emission data voltages may be supplied as one of 256 voltages, although embodiments are not limited thereto. In the sensing mode, the data voltage supply unit 110 may convert the sensing setting data PDATA into sensing data voltages, and may respectively supply the sensing data voltages to the data lines D1 to Dp according to the data timing control signal DCS. Each of the sensing data voltages may be a voltage for sensing a current of a driving transistor DT of the pixel.

The switching unit 120 may be connected to the sensing lines SE1 to SEp and the sensing data output unit 30. The switching unit 120 may connect the sensing lines SE1 to SEp to the sensing data output unit 30 in a particular order. For example, the particular order may be a sequential order. In such a case, the switching unit 120 may sequentially connect the sensing data output unit 30 to a first sensing line SE1 to a $p^{th}$ sensing line SEp.

The switching unit 120 may include a plurality of first switches SW11 to SW1*p* respectively connected to the sensing lines SE1 to SEp. The switching unit 120 may switch on the first switches SW11 to SW1*p* according to first switch signals SCS1 input from the timing controller 60, thereby connecting the sensing lines SE1 to SEp to the sensing data output unit 30 in a particular order.

The initialization voltage supply unit 130 may be connected to the sensing lines SE1 to SEp, and may supply an initialization voltage. The initialization voltage supply unit 130 may include a plurality of initialization switches SWR1 to SWRp. The initialization voltage supply unit 130 may switch on the initialization switches SWR1 to SWRp according to the initialization signal input from the timing controller 60, thereby connecting the sensing lines SE1 to SEp to a reference voltage line VREFL through which a reference voltage may be supplied. The initialization switches SWR1 to SWRp may receive the same initialization signal.

The reference voltage supply unit 140 provided outside the source driver IC 21 may generate the reference voltage for controlling a luminance of the entire display area AA of the display panel 10. The reference voltage supply unit 140 may be connected to the reference voltage line VREFL. The reference voltage supply unit 140 may transfer the generated reference voltage to the initialization voltage supply unit 130 through the reference voltage line VREFL.

The sensing data output unit 30 may be included in the source driver IC 21. The sensing data output unit 30 may be connected to the sensing lines SE1 to SEp by the switching unit 120, and may sense currents flowing in the sensing lines SE1 to SEp. That is, the sensing data output unit 30 may convert the current, flowing in each of sensing lines SE1 to SEp, the into a voltage, and may convert the voltage into sensing data SD including information for sensing and compensation. The sensing data output unit 30 may output the sensing data SD to the timing controller 60. Therefore, the timing controller 60 may sense whether or not a data voltage is normal, based on the sensing data SD, and may perform compensation.

The sensing voltage supply unit 150 may be included in the source driver IC 21. The sensing voltage supply unit 150 may perform a function of the sensing driver 50 of the FIG. 1 example. The sensing voltage supply unit 150 may supply a sensing signal, which may be necessary for sensing, to each of the sensing signal lines SS1 to SSn. Each of the sensing signal lines SS1 to SSn, as described above with reference to FIG. 2, may supply the sensing signal to turn on the second transistor ST2 that performs a sensing operation. Accordingly, the sensing signal may be a voltage that is supplied to a pixel for performing sensing, and thus, may be defined as a sensing voltage.

The sensing voltage supply unit 150 may be included in each of the source driver ICs 21. The sensing voltage may be generated in each of the source driver ICs 21, and may be supplied to each of the sensing signal lines SS1 to SSn. When the sensing voltage is generated in each of the source driver ICs 21 and is supplied to each of the sensing signal lines SS1 to SSn, a sensing voltage suitable for an area characteristic of the display panel 10 may be supplied.

The area characteristic of the display panel 10 denotes a block-based characteristic of the display area AA of the display panel 10. The area characteristic of the display panel 10 is shown when the display panel 10 includes a large-size display area AA. The area characteristic of the display panel 10 denotes a characteristic in which a level of a supplied voltage is reduced progressively closer to both ends, e.g., the left and right sides, of the display panel 10. This may occur because, due to a length difference of lines connected between a C-PCB and the display panel 10, voltage drop caused by a resistance of each of the lines increases progressively closer to both ends of the display panel 10. Another cause may be a difference between physical characteristics of the pixels provided in the display panel 10.

The area characteristic of the display panel 10 may be defined as voltage drop in which levels of the sensing voltage, the data voltage, and the reference voltage supplied from the C-PCB are reduced progressively closer to the both ends of the display panel 10. External compensation may be sensitive to power that is supplied to the source driver IC 21, and may be necessary for sensing. Thus, when the voltage drop occurs, an error may occur in sensing data.

When the sensing voltage supply unit 150 is included in each of the source driver ICs 21, a sensing voltage corresponding to the area characteristic of the display panel 10 connected to each of the source driver ICs 21 may be supplied. In detail, each of the sensing voltage supply units 150 may supply a sensing voltage to supply a uniform data voltage to the entire display area, and may prevent a luminance difference caused by the area characteristic of the display panel 10.

For each of the source driver ICs 21 to supply the sensing voltage suitable for the area characteristic of the display panel 10, the sensing voltage supply unit 150 may be supplied with a sensing power control signal from the timing controller 60. The sensing power control signal may be included in an embedded point-to-point interface (EPI) packet protocol, which is a communication protocol set for transmitting a rising time of a clock and color-based digital video data of each pixel, when supplying the digital video data DATA to the source driver IC 21 through an output terminal of the timing controller 60. The EPI packet protocol may include a plurality of bits (for example, 24 bits) for each frame, although embodiments are not limited thereto. One of dummy bits included in the EPI packet protocol may be set as a bit for controlling a logic level of the sensing voltage of the sensing voltage supply unit 150 included in the source driver IC 21. The timing controller 60 may set bits included in the EPI packet protocol to have different sensing voltages for each of the source driver ICs 21. Accordingly, the timing controller 60 may individually control a level of the sensing voltage output from the sensing voltage supply unit 150.

In an embodiment of the present disclosure, when each of the source driver ICs 21 includes the sensing voltage supply unit 150, the source driver IC 21 connected to an area where luminance has been reduced may supply a high sensing voltage, thereby performing external compensation to supply a data voltage and a reference voltage to a corresponding area at a high level. On the other hand, the source driver IC 21 connected to an area where luminance has increased may supply a low sensing voltage, thereby performing external compensation to supply the data voltage and the reference voltage to a corresponding area at a low level. Accordingly, external compensation for decreasing a luminance deviation between the areas of the display panel 10 may be performed.

With reference to FIG. 4, the source driver IC 21 according to another embodiment of the present disclosure is the same as the source driver IC 21 according to an embodiment of the present disclosure illustrated in FIG. 3, except that a reference voltage supply unit 140 may be included in the source driver IC 21. In a case in which the reference voltage supply unit 140 is included in the source driver IC 21, as in the source driver IC 21 according to another embodiment of the present disclosure, a reference voltage generated by the reference voltage supply unit 140 may be transferred to an initialization voltage supply unit 130 in the source driver IC 21 that is provided in plurality.

When the reference voltage supply unit 140 is included in each of the source driver ICs 21, the reference voltage may be supplied based on the area characteristic of the display panel 10 connected to each of the source driver ICs 21. Therefore, a deviation of a level of the reference voltage based on the area of the display panel 10 may be reduced in comparison with a case in which an external reference voltage supply unit 140 supplies the reference voltage to the entire display panel 10. The reference voltage may control a luminance of the entire display area AA. Thus, when the level of the reference voltage becomes uniform, luminance may become uniform. Accordingly, when the reference voltage supply unit 140 is included in each of the source driver ICs 21, a luminance of the display area AA may become uniform, and block dim may be prevented.

With reference to FIG. 5, in a display panel 10 of the organic light-emitting display device 10 according to an embodiment of the present disclosure, a display area AA may be divided into a plurality of display area blocks AA1 to AA5. In FIG. 5, an example in which the display area AA is divided into five display area blocks AA1 to AA5 is illustrated, but embodiments are not limited thereto. In some embodiments, depending on the case, the display area AA may be divided into fewer or more display area blocks than the number of illustrated blocks.

In each of the display area blocks AA1 to AA5, a plurality of sensing signal lines SS and a plurality of sensing lines SE may be arranged to respectively extend from a plurality of source driver ICs 21. Therefore, the number of the display area blocks may be the same as the number of the source driver ICs 21. Accordingly, in FIG. 5, because the number of the source driver ICs 21 is five, an example in which the number of the display area blocks AA1 to AA5 is five is illustrated.

The sensing signal lines SS and the sensing lines SE extending from the respective source driver ICs 21 may be connected to pixels provided in the display area blocks AA1 to AA5. Although not shown in FIG. 5, as described above with reference to FIG. 2, each of the sensing signal lines SS may be connected to a gate electrode of a second transistor ST2 of a pixel, and may supply a sensing voltage for starting sensing. Each of the sensing lines SE may be connected to a drain electrode of the second transistor ST2, and may sense a sensing current. Portions of sensing data for performing external compensation may be generated based on the sensing voltage and the sensing current.

In one example, the sensing signal lines SS and the sensing lines SE may not be connected to each other between adjacent display area blocks. Therefore, each of the source driver ICs 21 may supply a sensing voltage having a level corresponding to a characteristic of a corresponding display area block of the display area blocks AA1 to AA5.

A timing controller 60 may include a digital video data compensator 70 and may be mounted on a C-PCB 80. Functions of the timing controller 60 and the digital video data compensator 70 are substantially similar to the functions described above with reference to FIG. 1. Thus, their detailed descriptions are omitted.

The source driver ICs 21 may be respectively mounted on a plurality of flexible films 90. Each of the flexible films 90 may be a tape carrier package (TCP) or a chip on film (COF). The COF may include a base film, such as polyimide, and a plurality of conductive lead lines provided on the base film. The flexible films 90 may be bent or curved. The flexible films 90 may each be attached on the display panel 10 and the C-PCB 80. For example, each of the flexible films 90 may be attached on the display panel 10 in a tape automated bonding (TAB) type by using an anisotropic conductive film (ACF). Thus, the source driver ICs 21 may be connected to the sensing signal lines SS and the sensing lines SE.

Figure 6:
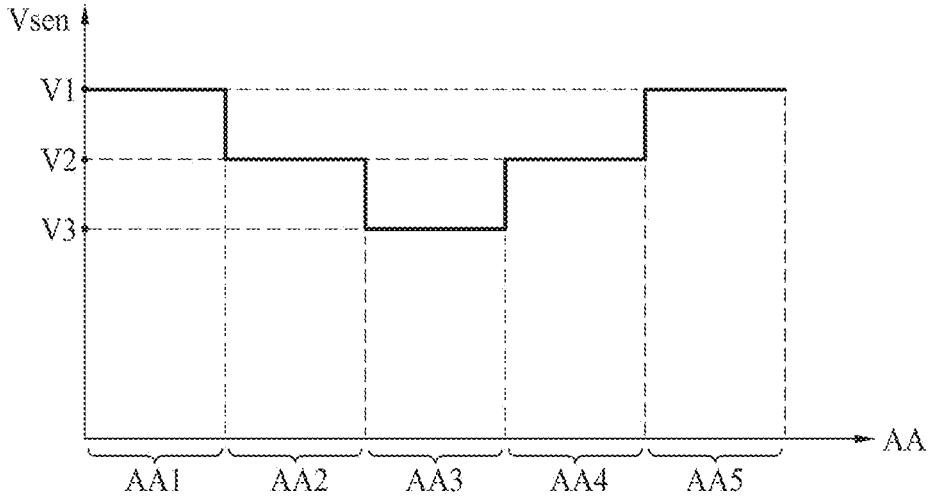
FIG. 6 is a waveform diagram of an input sensing voltage with respect to an area of a display panel of an organic light-emitting display device according to an embodiment of the present disclosure.
Figure 7:
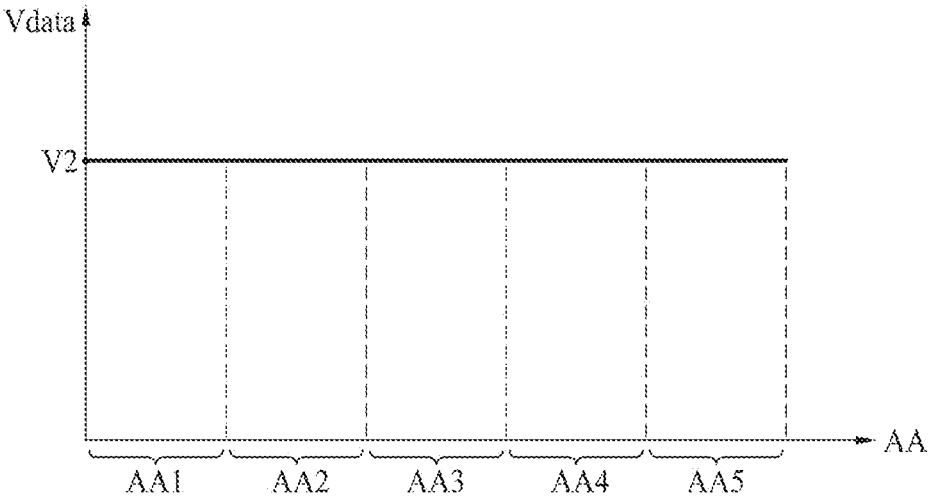
FIG. 7 is a waveform diagram of an output data voltage with respect to an area of a display panel of an organic light-emitting display device according to an embodiment of the present disclosure.

FIG. 6 is a waveform diagram of an input sensing voltage with respect to an area of a display panel of an organic light-emitting display device according to an embodiment of the present disclosure. FIG. 7 is a waveform diagram of an output data voltage with respect to an area of a display panel of an organic light-emitting display device according to an embodiment of the present disclosure.

For example, as described above, data voltages of display area blocks AA1 and AA5 disposed in both ends among a plurality of display area blocks AA1 to AA5 may be lower than a data voltage of the display area block AA3 disposed in a center portion. Because a difference may occur between the data voltage of each of the display area blocks AA1 and AA5 disposed in the both ends and the data voltage of the display area block AA3 disposed in the center portion, a luminance deviation between the display area blocks AA1 to AA5 may occur.

To decrease a luminance deviation between the display area blocks AA1 and AA5, each of the source driver ICs 21 may supply sensing voltages Vsen for reducing the luminance deviation between the display area blocks AA1 and AA5. As such, the source driver IC 21 connected to the sensing signal lines SS and the sensing lines SE in the display area blocks AA1 and AA5 disposed in the both ends may supply the sensing voltage Vsen at a first logic level V1. The source driver IC 21 connected to the sensing signal lines SS and the sensing lines SE in the display area blocks AA2 and AA4, instead of the ends (e.g., the display area blocks AA1 and AA5) and the center portion, may supply the sensing voltage Vsen at a second logic level V2. Also, the source driver IC 21 connected to the sensing signal lines SS and the sensing lines SE in the display area block AA3 in the center portion may supply the sensing voltage Vsen at a third logic level V3.

The first logic level V1 may be higher than the second logic level V2, and the third logic level V3 may be lower than the second logic level V2. Therefore, in the display area blocks AA1 and AA5 disposed at the two ends, external compensation may be performed to increase a data voltage that is supplied based on the sensing voltage having the first logic level V1. In the display area blocks AA2 and AA4, instead of the ends and the center portion, to maintain the sensing voltage having the second logic level V2 supplied based on the sensing voltage having the second logic level V2, external compensation may not be performed, or only slight compensation for reducing or removing a voltage ripple may be performed. Also, in the display area block A3 in the center portion, external compensation may be performed to lower a data voltage that may be supplied based on the sensing voltage having the third logic level V3.

External compensation may be performed for each of the display area blocks AA1 to AA5. Then, as shown in the FIG. 7 example, all of the display area blocks AA1 to AA5 may have a data voltage Vdata having the second logic level V2. The data voltage Vdata having the same level may be supplied to all of the display area blocks AA1 to AA5, thereby decreasing or removing a luminance deviation between the display area blocks AA1 to AA5.

The data lines Dj connected to the driving transistors DT of the pixels P displaying an image, and the sensing signal lines SS connected to the sensing transistors ST2 of the pixels P, may be arranged in the display panel 10 of the organic light-emitting display device according to an embodiment of the present disclosure. As illustrated in the example of FIG. 2, when each of the scan lines Sk turns on the first transistor ST1, each of the data lines Dj may be connected to the gate electrode of the driving transistor DT. Each of the sensing signal lines SS may be connected to the gate electrode of the second transistor ST2. When a sensing signal is supplied through each of the sensing signal lines SS, the second transistor DT may be turned on, and sensing data for external compensation may be sensed through the sensing lines SS. Accordingly, because the sensing signal may be a signal for starting sensing, the sensing signal may be defined as a "sensing voltage," and because the second transistor ST2 may transfer the sensing data to the sensing lines SE, the second transistor ST2 may be defined as a "sensing transistor."

The source driver IC 21 of the organic light-emitting display device according to an embodiment of the present disclosure may supply the data voltages Vdata to the data lines Dj, and may supply the sensing voltages Vsen to the sensing signal lines SS. Each of the source driver ICs 21 may include the sensing voltage supply unit 150 that may generate the sensing voltages Vsen. In each of the source driver ICs 21, the sensing voltage supply unit 150 may generate the sensing voltages Vsen, based on a characteristic of a display area block connected thereto, and may supply the sensing voltages Vsen to the display area block.

The timing controller 60 may supply the digital video data DATA and the data timing control signal DCS to the source driver IC 21. The timing controller 60 may supply the sensing power control signal, which may control the sensing voltage supply unit 150, to the source driver IC 21. The timing controller 60 may add a bit for controlling a sensing power into the EPI packet protocol, which is supplied from the output terminal to the source driver IC 21, and may supply the sensing power control signal to the source driver IC 21. Accordingly, the timing controller 60 may control each of the source driver ICs 21 to generate the sensing voltage Vsen, based on a characteristic of a display area block.

In one example, the source driver ICs 21 may each include a digital-analog converter (DAC) that may generate the sensing voltages Vsen corresponding to sensing power information transmitted according to the EPI packet protocol. The DAC may generate the sensing voltages Vsen to be supplied to corresponding pixels, based on the sensing power information transmitted according to the EPI packet protocol, and may supply the sensing voltages Vsen to the sensing signal lines SS.

At this time, the timing controller 60 may supply a DAC control signal, which may control the DAC, to the source driver ICs 21. As described above, a difference between data voltages supplied to the display area blocks AA1 to AA5 may occur due to a resistance value difference caused by a length difference between lines and a physical difference between the pixels provided in the display area blocks AA1 to AA5. The timing controller 60 may be supplied overall with information about the difference between the data voltages. To decrease the difference, the timing controller 60 may control the source driver ICs 21 to generate different sensing voltages Vsen. Therefore, in a case in which the timing controller 60 directly supplies the DAC control signal for controlling the DAC to the source driver ICs 21, a deviation between data voltages of the display area blocks AA1 to AA5 may be more easily reduced or removed.

The source driver ICs 21 according to an embodiment of the present disclosure may supply the sensing voltages Vsen to reduce a luminance deviation between the display area blocks AA1 to AA5. As described above, the source driver ICs 21 may supply different sensing voltages Vsen to the display area blocks. To reduce a deviation, each of the source driver ICs 21 may supply the sensing voltage Vsen having a high logic level to a display area block where the data voltage Vdata was low, and may supply the sensing voltage Vsen having a low logic level to a display area block where the data voltage Vdata was high. In such a case, external compensation may be performed for each of the display area blocks AA1 to AA5. Then, all of the display area blocks AA1 to AA5 may have the data voltage Vdata having the second logic level V2. Accordingly, the data voltage Vdata having the same level may be supplied to all of the display area blocks AA1 to AA5, thereby reducing or removing the luminance deviation between the display area blocks AA1 to AA5.

As described above, in an embodiment of the present disclosure, the reference voltage supply unit 40 may be included in each of the source driver ICs 21. In such a case, the reference voltage may be supplied based on an area characteristic of the display panel 10 connected to each of the source driver ICs 21. Therefore, a deviation of a level of the reference voltage based on the area of the display panel 10 may be reduced in comparison with a case in which the external reference voltage supply unit 140 supplies the reference voltage to an entire area of the display panel 10, e.g., to the entire display panel 10. The reference voltage may control a luminance of the entire display area AA. Thus, when the level of the reference voltage becomes uniform, luminance may become uniform. Accordingly, when the reference voltage supply unit 140 is included in each of source driver ICs 21, a luminance of the display area AA may become uniform, and block dim may be prevented.

A driving method of an organic light-emitting display device according to an embodiment of the present disclosure may include the following operations. First, the timing controller 60 may supply the digital video data DATA and the data timing control signal DCS to the source driver IC 21. In such a case, the driving method may include an operation of supplying, by the timing controller 60, the sensing power control signal for controlling the sensing voltage supply unit 150 to the source driver IC 21. Therefore, the timing controller 60 may control each of the source driver ICs 21 to generate the sensing voltage Vsen, based on a characteristic of a display area block.

In one example, the driving method may include an operation of supplying, by the timing controller 60, the DAC control signal for controlling the DAC to the source driver IC 21. In a case in which the timing controller 60 directly supplies the DAC control signal for controlling the DAC to the source driver ICs 21, a deviation between data voltages of the display area blocks AA1 to AA5 may be more easily reduced or removed.

Second, the source driver IC 21 may supply the data voltages to the data lines Dj connected to the driving transistors DT of the pixels provided in the display panel 10. In another example, the reference voltage supply unit 140 included in the source driver IC 21 may supply the reference voltage for controlling a luminance of entire the display area AA of the display panel 10. In such a case, the driving method may include an operation of supplying the reference voltage based on an area characteristic of the display panel 10 connected to each of the source driver ICs 21. When the reference voltage supply unit 140 is included in each of the source driver ICs 21, the reference voltage may be supplied based on a characteristic of each of the display area blocks. Accordingly, by uniformly supplying the reference voltage, a luminance of the display area AA may become uniform, and block dim may be prevented.

Third, each of the source driver ICs 21 may generate the sensing voltages Vsen. The source driver ICs 21 may each include the sensing voltage supply unit 150 that may sense the sensing voltages Vsen. In the above-described example, the driving method may include an operation of generating, by the DAC of the source driver IC 21, the sensing voltages Vsen based on the sensing power information transmitted according to the EPI packet protocol.

Fourth, the source driver IC 21 may supply the sensing voltages to the sensing signal lines SS connected to the sensing transistors ST2 of the pixels provided in the display panel 10. In such a case, the driving method may include an operation of supplying the sensing voltage Vsen having a high logic level to a display area block where the data voltage Vdata was low, and supplying the sensing voltage Vsen having a low logic level to a display area block where the data voltage Vdata was high. Accordingly, the data voltage Vdata having the same level may be supplied to all of the display area blocks AA1 to AA5, thereby reducing or removing the luminance deviation between the display area blocks AA1 to AA5.

As described above, according to embodiments of the present disclosure, the sensing voltage supply unit may be included in each of the source driver ICs. Also, the sensing signal lines connected to each of the source driver ICs may be divided in units of one display area block. Each of the source driver ICs may supply a sensing voltage corresponding to a characteristic of a corresponding display area block. For example, the sensing voltage may be supplied to decrease a deviation of data voltages of the display panel. Accordingly, voltage drop, in which levels of a sensing voltage, a data voltage, and a reference voltage are reduced progressively closer to ends of the display panel, may be prevented.

It will be apparent to those skilled in the art that various modifications and variations may be made in the present disclosure without departing from the technical idea or scope of the disclosure. Thus, it is intended that embodiments of the present disclosure cover the modifications and variations of the disclosure provided they come within the scope of the appended claims and their equivalents.

What is claimed is:

1. An organic light-emitting display device, comprising:

a display panel including:

a plurality of pixels configured to display an image, each pixel among the plurality of pixels including a driving transistor and a sensing transistor;

a plurality of data lines respectively connected to each driving transistor; and a plurality of sensing signal lines respectively connected to each sensing transistor;

a plurality of source drive integrated circuits (ICs) individually connected to each of display area blocks, and configured to:

supply data voltages to the plurality of data lines; and supply sensing voltages to the plurality of sensing signal lines; and a timing controller configured to supply digital video data and a data timing control signal to each of the plurality of source driver ICs, wherein each of the plurality of source driver ICs comprises a sensing voltage supply unit configured to:

generate a respective sensing voltage among the sensing voltages, the respective sensing voltage having a respective level based on a characteristic of a display area block connected thereto, the characteristic including a length difference between lines connected between the timing controller and the display panel, and supply the respective sensing voltage to the display area block connected thereto.

2. The organic light-emitting display device of claim 1, wherein the timing controller is further configured to supply a sensing power control signal, for controlling the sensing voltage supply unit, to each of the plurality of source driver ICs.

3. The organic light-emitting display device of claim 2, wherein:

each source driver IC includes a digital-analog converter (DAC) configured to generate the sensing voltages corresponding to sensing power information transmitted according to an embedded point-to-point interface (EPI) packet protocol; and the timing controller is further configured to supply a DAC control signal, for controlling the DAC, to each of the plurality of source driver ICs.

4. The organic light-emitting display device of claim 1, wherein each of the plurality of source driver ICs is further configured to:

supply a sensing voltage having a high logic level to the display area block where a data voltage is determined to be low; and supply a sensing voltage having a low logic level to the display area block where a data voltage is determined to be high.

5. The organic light-emitting display device of claim 1, wherein each of the plurality of source driver ICs comprises a reference voltage supply unit configured to:

supply a reference voltage for controlling a luminance of the display area block of the display panel; and supply the reference voltage based on an area characteristic of the display area block connected to each of the plurality of source driver ICs.

6. A driving method of an organic light-emitting display device, the driving method comprising:

supplying, by a timing controller, digital video data and a data timing control signal to each of a plurality of source drive integrated circuits (ICs) connected to each of display area blocks;

supplying, by each of the plurality of source driver ICs, data voltages to a plurality of data lines connected to driving transistors of a plurality of pixels provided in the display area block;

generating, by each of the plurality of source driver ICs, a respective sensing voltage having a respective level based on a characteristic of a display area block connected thereto, the characteristic including a length difference between lines connected between the timing controller and the display panel; and supplying, by each of the plurality of source driver ICs, the respective sensing voltage to a plurality of sensing signal lines connected to sensing transistors of the plurality of pixels provided in the display area block, wherein each of the plurality of source driver ICs comprises a sensing voltage supply unit generating the respective sensing voltage.

7. The driving method of claim 6, wherein the supplying of the digital video data and the data timing control signal comprises supplying a sensing power control signal, for controlling the sensing voltage supply unit, to each of the plurality of source driver ICs.

8. The driving method of claim 7, wherein:

the generating of the sensing voltages comprises, by using a digital-analog converter (DAC) of each of the plurality of source driver ICs, generating the sensing voltages corresponding to sensing power information transmitted according to an embedded point-to-point interface (EPI) packet protocol; and the supplying of the digital video data and the data timing control signal further comprises supplying a DAC control signal, for controlling the DAC, to each of the plurality of source driver ICs.

9. The driving method of claim 6, wherein the supplying of the sensing voltages comprises:

supplying a sensing voltage having a high logic level to a display area block where a data voltage is determined to be low; and supplying a sensing voltage having a low logic level to a display area block where a data voltage is determined to be high.

10. The driving method of claim 6, wherein the supplying of the data voltages comprises supplying, by a reference voltage supply unit included in each of the plurality of source driver ICs, a reference voltage for controlling a luminance of the display area block of the display panel, the reference voltage being supplied based on an area characteristic of the display area block connected to each of the plurality of source driver ICs.

* * * * *